US005983952A

United States Patent [19]

Carpenter et al.

[11] Patent Number: 5,983,952

[45] Date of Patent: Nov. 16, 1999

[54] SYSTEM AND METHOD FOR FORMING A FABRIC HAVING A SYNCHRONIZED WOVEN DESIGN AND PRINTED DESIGN

[75] Inventors: Jeff A. Carpenter, Columbus, N.C.; Lawrence F. Houghton, Roebuck; Martin Wildeman, Spartanburg, both of S.C.

[73] Assignee: Tietex International, Ltd., Spartanburg, S.C.

[21] Appl. No.: 09/042,123

[22] Filed: Mar. 13, 1998

[51] Int. Cl.[6] ..... D06B 1/10; D03D 23/00

[52] U.S. Cl. ..... 139/1 R; 139/383 R; 139/416; 28/163; 28/184; 428/196; 8/151

[58] Field of Search ..... 139/1 R, 383 R, 139/68, 416; 28/184, 163; 428/196; 8/151

[56] References Cited

U.S. PATENT DOCUMENTS

| | | | |
|---|---|---|---|
| 418,206 | 12/1889 | Mellor | 28/32 |
| 538,863 | 5/1895 | Boyer | 28/72.5 |
| 1,795,770 | 3/1931 | Fromuth | 28/72.5 |
| 2,002,359 | 5/1935 | Baylis | 28/32 |
| 2,522,816 | 9/1950 | Fiderer | 28/72.5 |
| 3,692,611 | 9/1972 | Kühnle . | |
| 3,744,035 | 7/1973 | Geirhos et al. . | |
| 3,924,244 | 12/1975 | Seitz . | |
| 3,925,139 | 12/1975 | Simmons . | |
| 3,955,379 | 5/1976 | Corbiere . | |
| 3,958,406 | 5/1976 | Coriére . | |
| 3,994,146 | 11/1976 | Murase . | |
| 4,005,569 | 2/1977 | Corbiere . | |
| 4,078,253 | 3/1978 | Kajiura et al. . | |
| 4,086,112 | 4/1978 | Porter . | |
| 4,089,728 | 5/1978 | Teed . | |
| 4,259,994 | 4/1981 | Hobson | 139/1 R |
| 4,338,282 | 7/1982 | Motooka et al. . | |
| 4,357,189 | 11/1982 | Buckwalter et al. . | |
| 4,587,153 | 5/1986 | Sella | 428/196 |
| 4,660,261 | 4/1987 | Corbié . | |
| 4,725,486 | 2/1988 | Corbierére . | |
| 4,923,848 | 5/1990 | Akada et al. . | |
| 5,016,183 | 5/1991 | Shyong . | |
| 5,027,988 | 7/1991 | Corbiere . | |
| 5,058,174 | 10/1991 | Carroll . | |
| 5,136,519 | 8/1992 | Yonemitsu . | |
| 5,200,904 | 4/1993 | Tottman . | |
| 5,212,845 | 5/1993 | Corbiere . | |
| 5,307,283 | 4/1994 | Sawazaki et al. . | |
| 5,377,509 | 1/1995 | Corbiere . | |
| 5,791,381 | 8/1998 | Lepka et al. | 139/68 |

FOREIGN PATENT DOCUMENTS

| | | |
|---|---|---|
| 2254950 | 7/1975 | France . |
| 2360881 | 6/1974 | Germany . |
| 5375 | 7/1892 | Switzerland . |
| 1403887 | 8/1975 | United Kingdom . |
| 1466082 | 3/1977 | United Kingdom . |
| 1528411 | 10/1978 | United Kingdom . |
| 2324541 | 10/1998 | United Kingdom . |

OTHER PUBLICATIONS

Dornier brochure; Dornier air–jet weaving Machine Type DLW; Jan. 1996.

Bonas CSJ Electronic Jacquard brochure; Sep. 1996.

Cortex S.A. brochure.

*Primary Examiner*—Andy Falik

*Attorney, Agent, or Firm*—Dority & Manning, P.A.

[57] ABSTRACT

A weaving system is designed to automatically maintain a printed pattern in alignment with a woven pattern as a fabric is being formed. The printed pattern is printed onto the warp yarns. A controller is used to monitor the position of the printed pattern during the weaving process relative to the position of a woven pattern that is being formed into the fabric. Should the printed pattern and woven pattern fall out of alignment, the controller then alters the longitudinal size of the woven pattern, the printed pattern, or both patterns, in order to realign the patterns.

24 Claims, 4 Drawing Sheets

18
20
14
22
20
14

10
12
17
20
20
15
16
14
17
16

SYSTEM AND METHOD FOR FORMING A FABRIC HAVING A SYNCHRONIZED WOVEN DESIGN AND PRINTED DESIGN

FIELD OF THE INVENTION

The present invention is generally directed to a method of synchronizing a woven design with a printed design during the formation of a fabric. More particularly, the woven pattern and the printed pattern are synchronized by continuously monitoring the position of the printed pattern in relation to the woven pattern and then, based on their relative positions, making slight adjustments in order to maintain the patterns in alignment.

BACKGROUND OF THE INVENTION

Woven fabrics are produced on various types of weaving machines, commonly referred to as shedding devices. Examples of shedding devices include, for instance, a cam weaving device and a dobby weaving device, which generally produce fabrics having a single and uniform weave. More complicated weaving systems capable of producing fabrics containing multiple weaves are generally referred to as jacquard weaving systems.

A jacquard weaving system refers to a system of weaving that utilizes a highly versatile pattern mechanism to permit the production of large, intricate designs. The designs that are produced are the product of an intricate weave created by controlling the action of individual warp threads during the passage of each pick. For instance, fabrics can be produced containing a decorative or aesthetic visible pattern that appears where the weave has been varied. The visible pattern that is produced by changing the weave is typically referred to as a motif, which is surrounded by and contrasted with a ground weave. Jacquard weaving can be used to produce, for instance, tapestry, brocade, damask, brocatelle, besides various other constructions.

In the past, attempts have been made to incorporate printed patterns into woven fabrics. In particular, attempts have been made to produce a fabric containing a printed design in combination with a woven design. Having the capability of combining a printed design with a woven design offers the ability to produce fabrics containing many different patterns and colors that have a unique and distinctive appearance. Unfortunately, problems have been experienced in the past in being able to synchronize a printed design with a woven design. For instance, in many applications, it is difficult to print a design directly onto a preformed woven fabric, since many fabrics tend to have an uneven topography. Also, the prior art has generally been deficient in providing a system for applying a printed pattern to a woven fabric that contains controls which maintain the printed pattern in alignment as it is applied to the fabric.

In view of the above deficiencies and drawbacks, a need currently exists for a process for producing woven fabrics that include a synchronized printed pattern. Additionally, a need also exists for a system of applying a printed pattern to fabric that contains controls for maintaining the printed pattern in alignment. In this regard, it would also be desirable if a system for producing fabrics could be devised in which a printed pattern is incorporated into the fabric and, during production of the fabric, is maintained in alignment with other patterns that may be woven into the fabric, such as jacquard patterns.

SUMMARY OF THE INVENTION

The present invention recognizes and addresses the foregoing disadvantages, and other disadvantages of prior art constructions and methods.

Accordingly, it is an object of the present invention to provide an improved system for producing woven fabrics containing a printed pattern.

Another object of the present invention is to provide a weaving system that maintains a printed pattern in alignment with a woven pattern.

It is another object of the present invention to provide a fabric containing synchronized printed and woven patterns.

Still another object of the present invention is to provide a weaving system that maintains a printed pattern in alignment with a woven pattern.

These and other objects of the present invention are achieved by providing a method of synchronizing a woven pattern with a printed pattern during fabric formation. The woven pattern can be, for instance, a pattern produced by using different colored yarns and/or by changing the weave within the fabric, such as what occurs when a jacquard pattern is woven into the fabric. The method includes the steps of first printing a pattern onto a set of warp yarns, wherein the pattern has a determined longitudinal length. Weft yarns are then woven into the warp yarns for producing a fabric. In particular, the weft yarns are woven into the warp yarns in a manner such that a woven pattern is formed also having a longitudinal size.

As the fabric is being woven, the position of the printed pattern is monitored in relation to the position of the woven pattern. Should it be determined that the patterns are not in alignment, the longitudinal size of either the printed pattern, the woven pattern, or both is selectively varied. In particular, the longitudinal size of the patterns are varied so that images appearing in the woven pattern fall back into alignment with images appearing in the printed pattern.

For instance, the longitudinal size of the woven pattern can be varied by varying the density at which the weft yarns are woven into the warp yarns.

In one embodiment, the woven pattern can comprise a jacquard pattern which is formed into the fabric through the use of a jacquard controller which works in conjunction with a weaving device. In this embodiment, besides varying the density at which the weft yarns are woven into the warp yarns, the longitudinal size of the jacquard pattern can be varied by storing within the jacquard controller a plurality of preprogrammed jacquard patterns that are all substantially similar but yet vary in longitudinal size. Based upon the position of the printed pattern, one of the preprogrammed jacquard patterns can be selected for synchronizing the jacquard pattern with the printed pattern.

In order to vary the longitudinal size of the printed pattern, on the other hand, the tension being applied to the warp yarns upon which the printed pattern is applied can be increased or decreased. By varying the tension of the warp yarns, the printed pattern can become elongated or contracted.

As stated above, the printed pattern is maintained in alignment with the woven pattern by selectively varying the size of either pattern. In this manner, the process of the present invention is capable of correcting for slight variations in the patterns and the weaving process during formation of the fabric. A unique fabric product is produced wherein the longitudinal size of the printed pattern or the woven pattern is varied within the fabric in a manner so that the printed pattern remains synchronized with the woven pattern.

A system that may be used for carrying out the process of the present invention can include a weaving device that is configured to insert the weft yarns into the warp yarns. The weaving device, for instance, can be a cam weaving device, a dobby weaving device, or a jacquard weaving system. When forming a jacquard pattern into the fabric, a jacquard device can be placed in selective engagement with the warp yarns and can work in conjunction with the weaving device for producing a jacquard pattern.

In order to monitor the position of the printed pattern while the fabric is being woven, the warp yarns can include a plurality of registration marks that are placed at selected locations. For instance, the registration marks can be placed along an edge of the warp yarn at spaced apart intervals. A sensor, such as an optical sensor, can be configured to monitor the position of the printed pattern on the warp yarns by monitoring the position of the registration marks.

The system can further include a controller, such as microprocessor, in communication with the sensor, the weaving device, and/or the jacquard device if present. The controller can be configured to receive information from the sensor and, based on the information, to control the weaving device for selectively varying the longitudinal size of the woven pattern for maintaining the woven pattern in alignment with the printed pattern during formation of the fabric. For example, when an adjustment is necessary, the controller can send a signal to the weaving device for varying the density at which the weft yarns are inserted into the warp yarns, which varies the longitudinal size of the woven pattern.

Alternatively, when present, the jacquard device can include a jacquard controller preprogrammed with a plurality of jacquard patterns. The controller can be configured to vary the longitudinal size of a jacquard pattern by selecting one of the jacquard patterns stored in the jacquard controller, which is then woven into the fabric by the weaving device.

In another alternative embodiment of the present invention, the system can be capable of varying the longitudinal size of the printed pattern, instead of or in addition to varying the longitudinal size of the woven pattern, for maintaining the patterns in alignment. In this embodiment, the system can include a tension control device that is configured to place a determined amount of tension on the warp yarns as the fabric is being woven. The controller can be placed in communication with the tension control device for varying the tension on the warp yarns when the sensor indicates to the controller that the patterns have fallen out of alignment. By varying the tension on the warp yarns, the longitudinal size of the printed pattern can be selectively elongated and contracted as desired. The tension control device can be, for instance, a variable tension let-off roll or an S wrap roller.

Other objects, features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
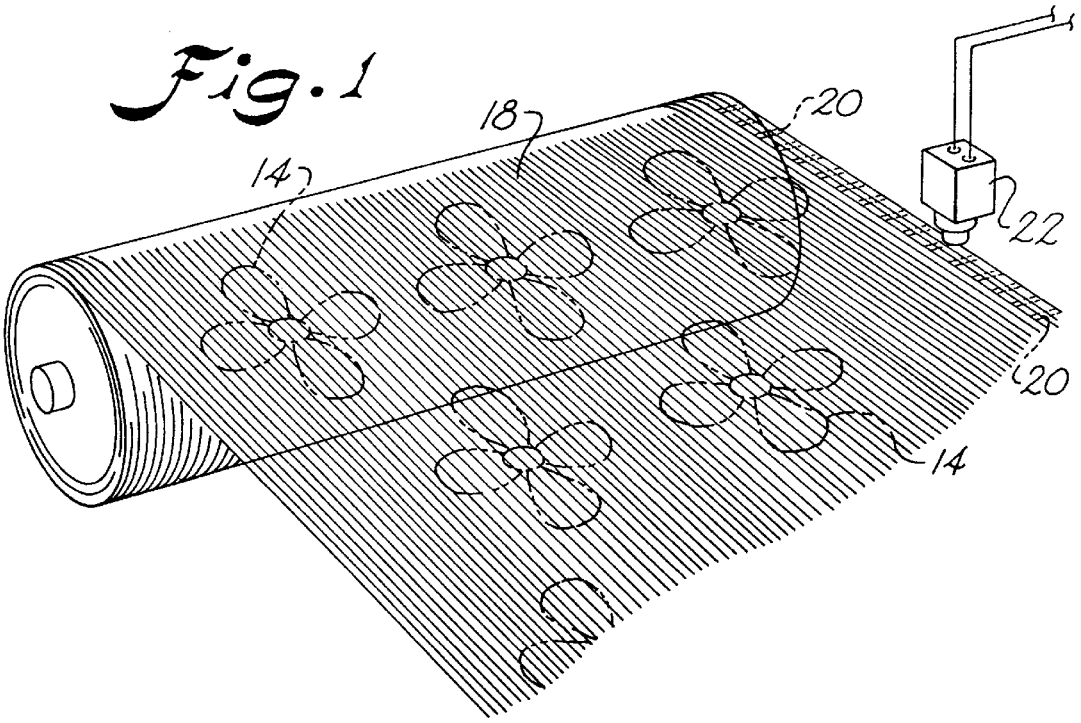
FIG. 1 is a perspective view of a set of warp yarns having a printed pattern thereon including a plurality of registration marks which are monitored by a sensor.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a weaving system designed to automatically synchronize a woven pattern with a printed pattern during the formation of a fabric. The woven pattern can be, for instance, a pattern woven into the fabric using different colored yarns and/or a pattern woven into the fabric by varying the weave. For example, in one embodiment, the woven pattern can be a jacquard pattern incorporated into the fabric. By maintaining the woven pattern in alignment with the printed pattern, both patterns can be used to enhance and compliment each other. Through the process of the present invention, fabric products can be produced having a unique and stylized overall design and appearance not before realized by prior art constructions.

The process of the present invention includes first printing a pattern, such as a multicolored pattern, onto the warp yarn.

Besides printing a pattern onto the warp yarns, registration marks can also be applied to the warp yarns at preselected locations which assist in determining the position of the printed pattern in relation to a weaving device as will be described in more detail hereinafter.

A computer controlled woven pattern is designed that exactly matches the printed warp pattern. The warp yarns are fed to a weaving device, and the woven pattern is cued to begin at the same point as the printed pattern. To maintain a match between the woven pattern and the printed pattern, both the warp pattern and the woven patterns are monitored. For instance, a sensor such as a photoelectric sensor, monitors advancement of the printed pattern by sensing the passing of each successive registration mark. The woven pattern, on the other hand, can be monitored by determining from the weaving device or loom (or from a jacquard controller if the woven pattern includes a jacquard pattern) the number of picks per inch and the total number of picks woven.

As long as the woven pattern and the printed pattern remain in alignment, the system takes no corrective action. If a controller, which controls the weaving device, detects any type of misalignment, the controller slightly changes the longitudinal size of the woven pattern and/or the longitudinal size of the printed pattern for maintaining both patterns in alignment.

As stated above, the woven pattern that is aligned with the printed pattern according to the present invention can be a pattern created in the fabric by using different colored yarns (particularly different colored weft yarns) and/or a pattern that is created into the fabric by changing the weave, such as is done when a jacquard pattern is formed. In general, any suitable weaving device may be used in the present invention that can form a woven pattern as described above. Examples of weaving devices include less complex devices such as a cam weaving device or a dobby weaving device. A cam device and a dobby device are capable of producing a woven fabric by varying the color of the weft yarns as they are inserted into the warp yarns. For example, a cam device or a dobby device is capable of producing a fabric with woven horizontal stripes which, in accordance with the present invention, can be aligned with a printed pattern applied to the warp yarns.

In one preferred embodiment of the present invention, the weaving device is a device that is capable of producing a woven pattern by not only varying the color of the weft yarns but also by varying the weave that is used to create the fabric. For illustrative purposes only, the drawings are directed to producing jacquard fabrics and to jacquard weaving systems. It should be understood, however, that other weaving devices as described above may be used in the present invention.

Figure 2:
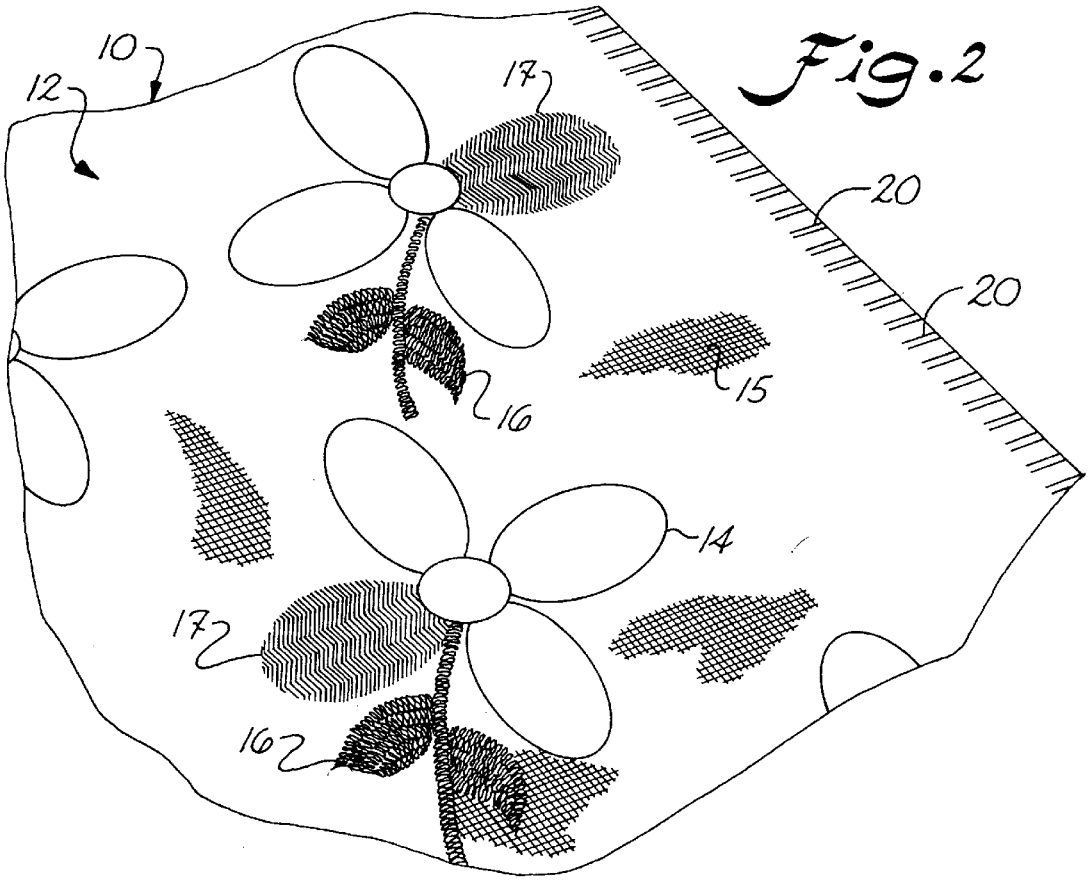
FIG. 2 is a partial perspective view of a fabric product made in accordance with the present invention illustrating a woven pattern and specifically a jacquard pattern in synchronization with a printed pattern.

Referring to FIG. 2, one embodiment of a jacquard fabric made in accordance with the present invention is illustrated. As shown, a fabric generally 10 includes a repeating jacquard pattern generally 12. Jacquard pattern 12 includes a ground weave 15 which, in this embodiment, is represented as a plain weave, and a first motif 16. Motif 16 is created by varying the weave within the fabric. In this embodiment, motif 16 is intended to represent the stem and leaves of a flower.

In one alternative embodiment, besides only containing first motif 16, jacquard pattern 12 can include various other motifs as desired. The other motifs can be made from the same weave or from a different weave than motif 16. For instance, as shown in FIG. 2, a second motif 17 is represented. In this embodiment, motif 17 is intended to represent and accentuate the petals of the flower. In this embodiment, motif 17 has a different weave than motif 16. For instance, motif 17 could have a herringbone weave which is a type of twill weave, while motif 16 could have a type of satin weave.

As shown in FIG. 2, fabric 10 further includes a printed pattern 14 which is synchronized with jacquard pattern 12. Printed pattern 14 is intended to represent a flower that is attached to the stem and leaves formed by the jacquard pattern as represented as motif 16.

Through the process of the present invention, various colors can be used if desired in order to accentuate the designs applied to the fabric. For instance, printed pattern 14 can be made from virtually any color desired. The woven pattern, however, which includes ground weave 15, first motif 16, and second motif 17, can be varied in color by selecting different colored weft yarns during production of the fabric. In this manner, motif 16 can have a different color than ground weave 15 which can have a different color than second motif 17.

Figure 3:
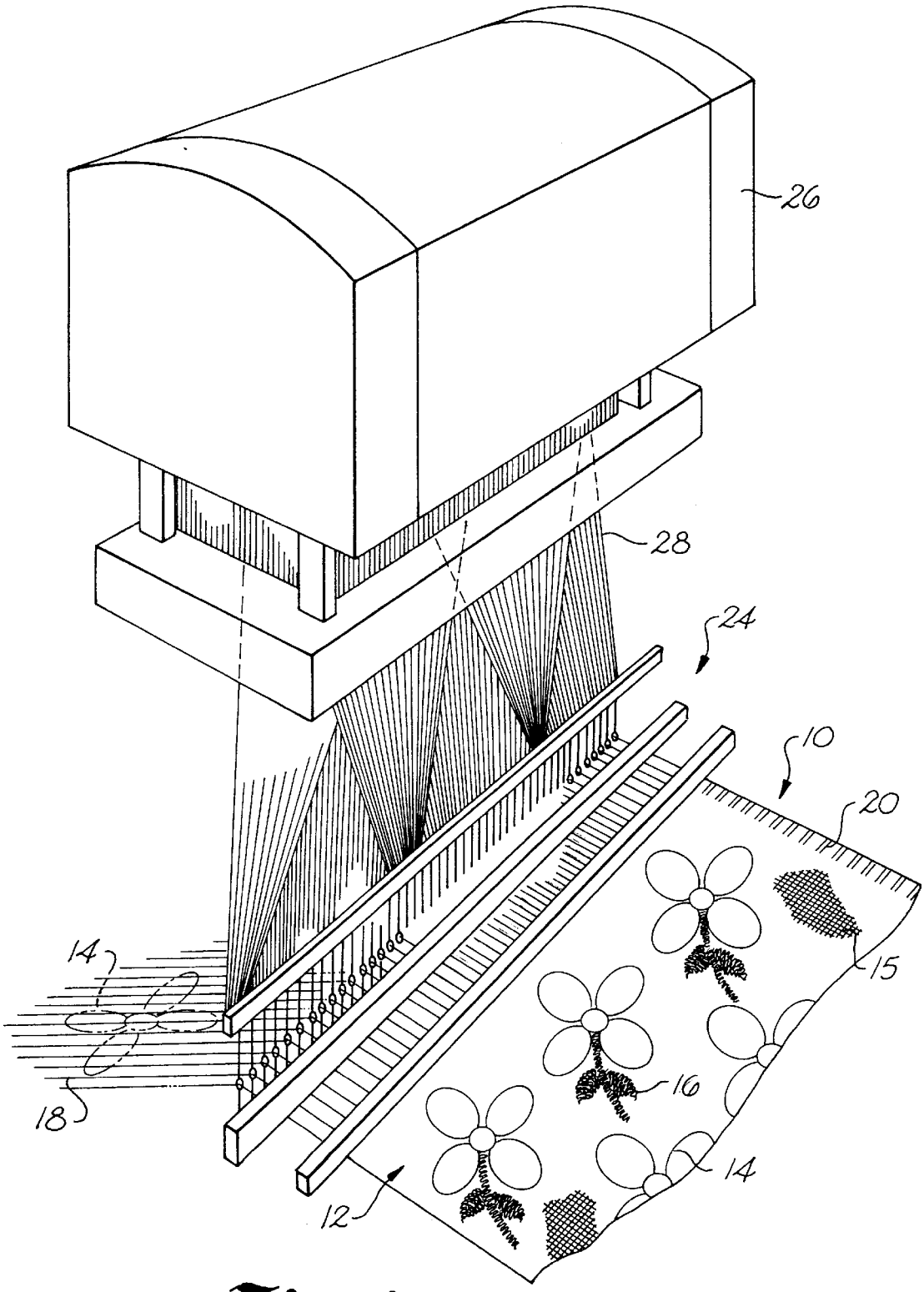
FIG. 3 is a perspective view of one embodiment of a jacquard device and a weaving device that may be used to produce a fabric made in accordance with the present invention.
Figure 4:
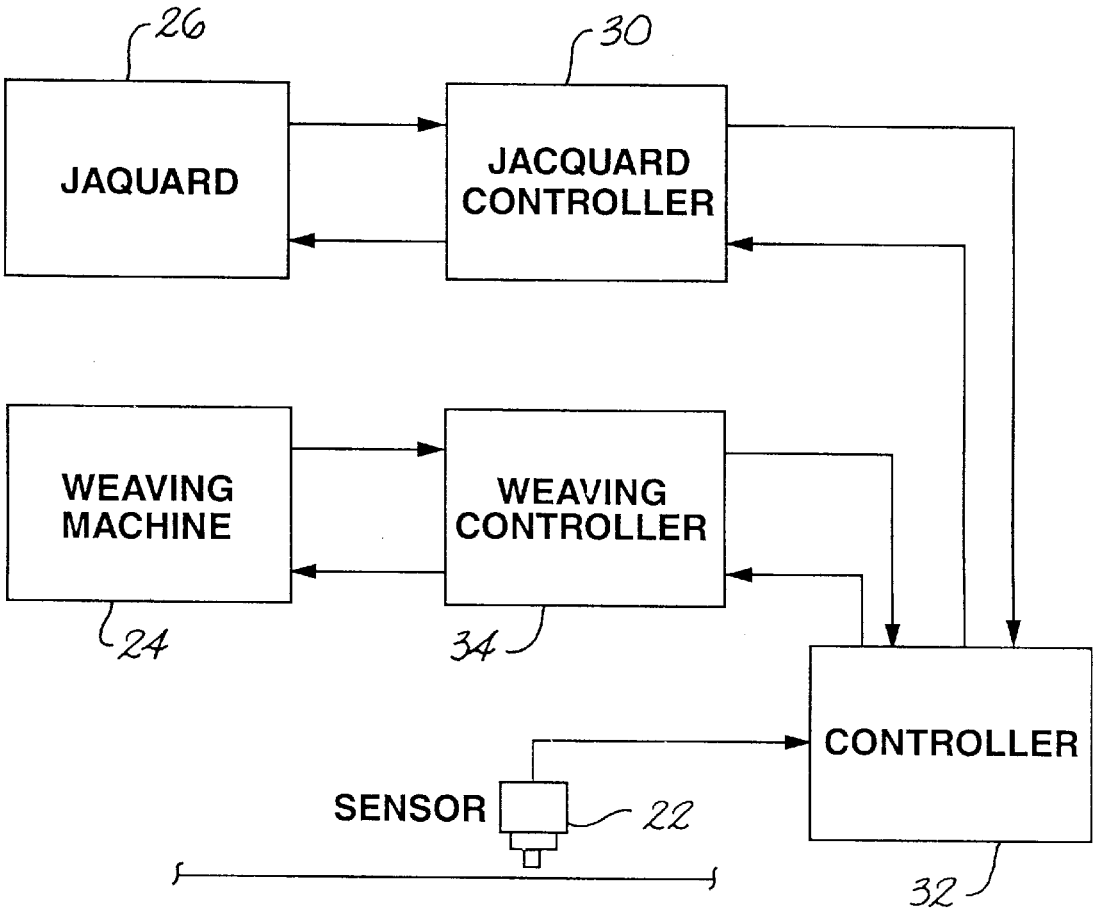
FIG. 4 is a plan view of one embodiment of a system made in accordance with the present invention.

Referring to FIGS. 1, 3 and 4, one embodiment of a system for producing fabrics in accordance with the present invention, such as fabric 10, is illustrated. Referring particularly to FIG. 1, a roll of warp yarns 18 is illustrated which, as shown, is in a condition ready to be fed to a weaving device in accordance with the present invention. Warp yarns 18 can be made from various materials, including synthetic polymers and natural fibers. For instance, although not critical to the process of the present invention, warp yarns 18 can be made from polyester. Also not critical, the yarns can be formed from staple fibers, monofilament fibers, or multifilament fibers.

For most applications, prior to being fed to a weaving device, warp yarns 18 can be sized using, for instance, a slasher. As is conventional, size compositions can be applied to the yarns in order to facilitate weaving. In particular, size compositions, such as starch solutions or polyester resins, decrease friction and can improve the strength of the yarns. Of importance, once warp yarns 18 have been sized and are ready to be incorporated into a fabric, it is preferable that the yarns be collected on to a roll under substantially constant tension. Maintaining the yarns in constant tension facilitates later synchronization between the printed pattern and the jacquard pattern.

As shown in FIG. 1, printed pattern 14 is applied to warp yarns 18 prior to forming the fabric of the present invention. Printed pattern 14 can be applied to the warp yarn at different times and using different methods. Preferably, the pattern will be applied uniformly to the warp yarns such that the pattern repeats at constant and uniform intervals.

Devices that can be used to apply printed pattern 14 to warp yarns 18 include a rotary screen printer, a jet printer, a heat transfer device, or a flexographic printing machine. In general, any suitable printing device can be used in the process of the present invention and is generally not critical.

Printed pattern 14 can be applied to warp yarns 18 either before a sizing composition is applied to the yarn or after a sizing composition has been applied. Further, in one embodiment, the printed pattern can be applied to the yarns while the yarns are simultaneously being fed into a weaving machine.

Besides printed pattern 14, warp yarns 18 also include a plurality of registration marks 20 placed at selected locations. For instance, as shown in the figures, the registration marks can comprise spaced apart horizontal lines that have been printed or otherwise applied to the selvage of warp yarns 18. For instance, in one embodiment, the horizontal lines printed on the selvage can be placed from about ¼ of an inch to about ½ of an inch apart. It should be understood, however, that besides horizontal marks, other types of indicia may be applied to the warp yarns for purposes of the present invention.

In general, registration marks 20 serve to signal the location or position of printed pattern 14 as the fabric product is being woven. More particularly, as shown in FIG. 1, a sensor 22 can be incorporated into the system for monitoring each registration mark as warp yarns 18 are advanced into a weaving device generally 24 as shown in FIG. 3. Sensor 22 which can be, for instance, an optical sensor such as a light sensor or a contrast scanner, is configured to generate a signal which can then be sent to a controller for determining the position of printed pattern 14 in order to align the printed pattern with a woven pattern being formed into the fabric as will be discussed in more detail below.

In an alternative embodiment, sensor 22 can be a pattern recognition device, such as a pattern recognition camera. Such devices are capable of recognizing and monitoring the position of a pattern without the use of registration marks 20.

Referring to FIG. 3, as shown, warp yarns 18 are fed into weaving device 24 which weaves weft yarns into the warp yarns for forming fabric 10. In order to form jacquard pattern 12 into fabric 10, weaving device 24 works in conjunction with a jacquard device 26. Jacquard device 26 includes a plurality of cords 28 which are in control of warp yarns 18. In particular, for most applications, each individual warp yarn will be connected to a separate and corresponding cord.

Cords 28 are adapted to lift selected warp yarns at predetermined times during the weaving operation. When selected warp yarns are lifted, a "shed" is formed through which the weft yarns are inserted. By controlling each individual warp yarn during the weaving process, intricate woven patterns can be formed into the fabric, such as motif 16.

In order to produce jacquard pattern 12 automatically, jacquard device 26 can include a jacquard controller and weaving device 24 can include a weaving controller. The jacquard controller can be preprogrammed with a jacquard pattern and can be placed in communication with the weaving controller. The weaving controller can be programed to control the density at which weft yarns are inserted into the warp yarns as the preprogrammed jacquard pattern is being woven into the fabric.

As described above, during the weaving process, the weaving device can be capable of inserting different colored weft yarns into the warp yarns. For example, most commercial weaving devices are capable of inserting up to eight (8) different colored yarns into the warp yarns. The weft yarns can be inserted into the warp yarns using a high pressure fluid or using a mechanical device. By inserting different colored yarns into the warp yarns at selected times, contrasting colors can be incorporated into the design appearing in the fabric. For instance, motif 16 can appear a different color than ground weave 15.

One of the primary objectives and advantages of the present invention is to form fabric 10 in a manner such that jacquard pattern 12 is synchronized with printed pattern 14. The system of the present invention is capable of maintaining both patterns in alignment by monitoring the position of each pattern as the fabric is being formed and, based upon the relative positions of the patterns, making automatic and continuous adjustments during the weaving process. Specifically, the patterns are maintained in alignment by varying the longitudinal size of one of the patterns or of both of the patterns as the fabric is produced.

For instance, in one embodiment, the longitudinal size of the jacquard pattern is varied during the process in order to maintain the jacquard pattern synchronized with the printed pattern. As used herein, the longitudinal size of a pattern refers to either the overall length of the pattern in the machine direction, the length of a repeating segment of the pattern in the machine direction, and/or the length of the individual images appearing in the pattern.

Referring to FIG. 4, one embodiment of a system for varying the longitudinal size of the jacquard pattern in relation to the printed pattern for maintaining the patterns in alignment is illustrated. As shown, jacquard device 26 is in communication with and controlled by a jacquard controller 30 which, in turn, is in communication with a controller 32. Weaving machine 24, on the other hand, is in communication with a weaving controller 34, which is also in communication with controller 32. As shown, controller 32 is further configured to receive information from sensor 22 which, as shown in FIG. 1 and as explained above, monitors the position of printed pattern 14 by sensing the location of registration marks 20. Jacquard controller 30, weaving controller 34, and controller 32 can all be programmable devices, such as microprocessors, computers, or other electronic computational devices.

During the process of producing fabric 10 as shown in FIGS. 2 and 3, controller 32 receives information from sensor 22 indicating the position of printed pattern 14 on weaving machine 24. In addition, controller 32 also monitors the progress and position of jacquard pattern 12 as it is formed. In particular, controller 32 can receive information from weaving controller 34 regarding the weft density, which refers to the number of picks per inch that are woven into the warp yarns. Controller 32 also can receive information regarding the number of picks that have been woven, which can be received from jacquard controller 30 or from weaving controller 34. By knowing the weft density and the number of picks woven, controller 32 can thus determine the position of jacquard pattern 12.

In accordance with the present invention, controller 32 is then configured to compare the position of printed pattern 14 in relation to the position of jacquard pattern 12 in order to determine if the patterns are in alignment. If the patterns are not in alignment, controller 32 sends signals to jacquard controller 30 and/or weaving controller 34 in order to change the longitudinal size of jacquard pattern 12 an amount necessary for both patterns to once again be in alignment.

For instance, in one embodiment, controller 32 causes the weft density to increase or decrease which causes the longitudinal size of the jacquard pattern to decrease or increase respectively. In other words, if the number of picks woven in to the warp yarns per inch increases, a smaller sized jacquard pattern is produced and vice versa. Preferably, the adjustments that need to be made to the size of the jacquard pattern during production of the fabric are very slight such that the variances in size of the jacquard images are difficult if not impossible to see with the human eye.

In an alternative embodiment, in order to vary the size of jacquard pattern 12, jacquard controller 30 can be preprogrammed with a plurality of similar but slightly different sized jacquard patterns. In this embodiment, controller 32 can determine the relative positions of printed pattern 14 with respect to jacquard pattern 12 and, if an adjustment is needed, select one of the preprogrammed patterns contained within jacquard controller 30 that will realign the pattern. Again, preferably controller 32 monitors the relative positions of the patterns continuously and, when adjustments are needed, only slightly varies the size of the jacquard pattern.

Besides varying the size of jacquard pattern 12, the system of the present invention can also be configured to vary the longitudinal size of printed pattern 14. For instance, referring to FIG. 5, one embodiment of a system is illustrated that is capable of varying the longitudinal size of the printed pattern either alone or in combination with the system illustrated in FIG. 4.

Figure 5:
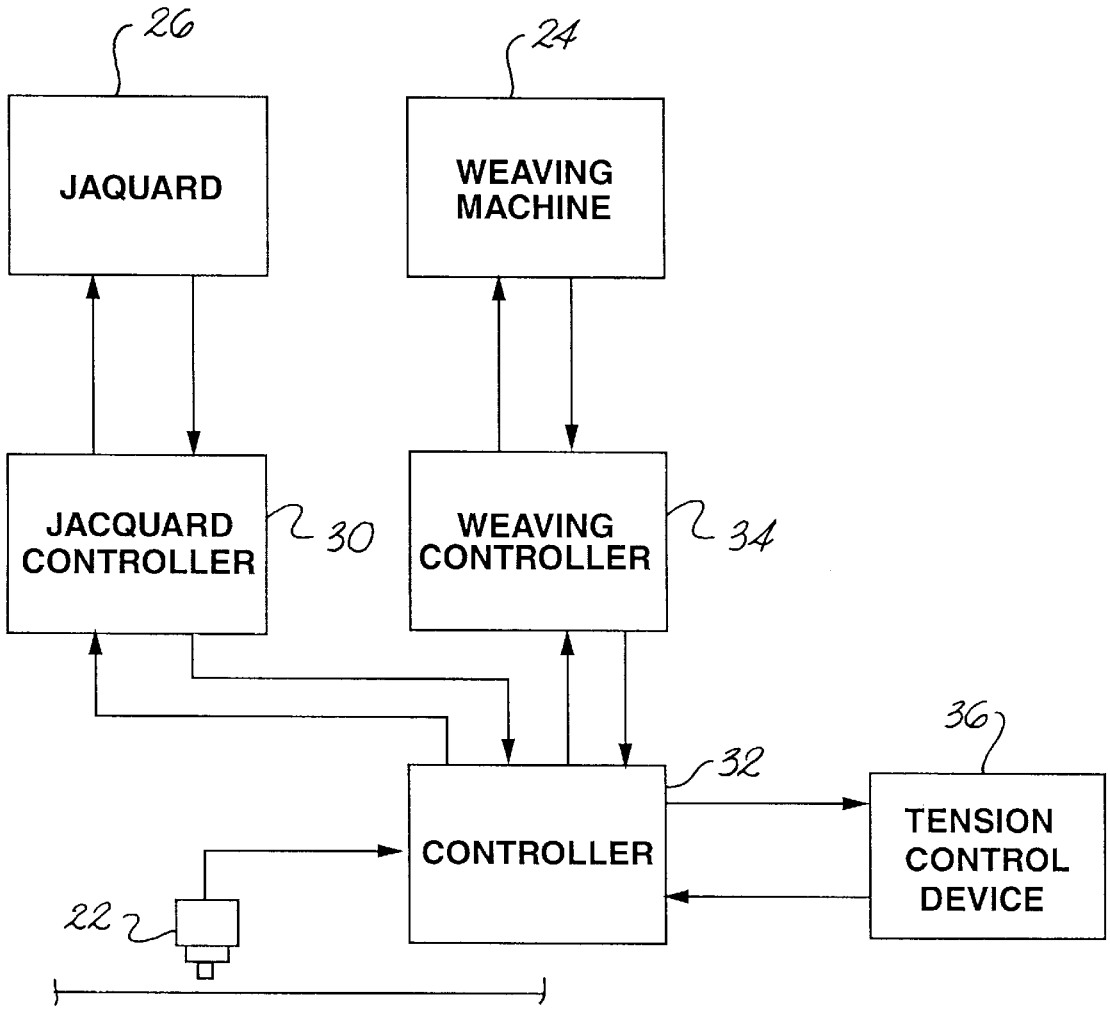
FIG. 5 is a plan view of an alternative embodiment of a system made in accordance with the present invention.

As shown in FIG. 5, in this embodiment, the weaving system of the present invention further includes a tension control device 36 which is in communication with controller 32. Tension control device 36 is a device that changes the amount of tension placed upon warp yarns 18 as fabric 10 is being produced. Specifically, the longitudinal size of printed pattern 14 can be varied by varying the amount of tension being placed upon the warp yarns. For instance, placing more tension upon the warp yarns will elongate the printed pattern, while placing a lesser amount of tension upon the warp yarns will contract the size of the pattern.

Tension control device 36 can be, for instance, a let-off beam that feeds the warp yarns into the weaving device. Alternatively, tension control device 36 can be a device placed in communication with the warp yarns either upstream or downstream from weaving machine 24. For example, tension control device 36 can be an S wrap roller preferably positioned to receive the warp yarns before entering weaving machine 24. In general, tension control device 36 can be any device capable of adjustably applying tension to the warp yarns.

In the embodiment illustrated in FIG. 5, controller 32 monitors the relative positions of printed pattern 14 and jacquard pattern 12 similar to the system illustrated in FIG. 4. When an adjustment is necessary in order to realign the patterns, controller 32 is configured to cause tension control device 36 to either increase or decrease the tension upon the warp yarns for elongating or contracting the longitudinal size of the printed pattern an amount necessary to realign the patterns.

As described above, besides jacquard weaving systems, the process of the present invention can be used with other weaving devices, such as a cam weaving device or a dobby weaving device. These systems will work similarly to the jacquard weaving system described above. A cam weaving device, however, may not contain its own controller. Thus, when incorporating a cam weaving device, controller 32 may only work in conjunction with weaving controller 34 for making adjustments to the longitudinal size of the woven pattern. A dobby weaving device, on the other hand, can contain its own controller which, depending upon the particular application, can be placed in communication with controller 32.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A method of synchronizing a woven pattern with a printed pattern during the fabrication of a woven product, said method comprising the steps of:

printing a pattern onto a set of warp yarns, said printed pattern having a predetermined longitudinal size;

inserting weft yarns into said warp yarns for producing a fabric, said weft yarns being woven into said warp yarns in a manner such that a woven pattern is formed into said fabric, said woven pattern also having a predetermined longitudinal size;

monitoring the position of said printed pattern as said fabric is being woven; and based on the position of said printed pattern, selectively varying the longitudinal size of at least one of said printed pattern or said woven pattern for maintaining said woven pattern in alignment with said printed pattern as said fabric is being formed.

2. A method as defined in claim 1, wherein said woven pattern is maintained in alignment with said printed pattern by selectively varying the longitudinal size of said woven pattern.

3. A method as defined in claim 2, wherein the longitudinal size of said woven pattern is varied by varying the density at which said weft yarns are woven into said warp yarns.

4. A method as defined in claim 2, wherein said woven pattern comprises a jacquard pattern and wherein the longitudinal size of said jacquard pattern is varied by selecting one of a plurality of preprogrammed jacquard patterns contained in a jacquard controller, said jacquard controller being in communication with a weaving device which controls said weft yarns for weaving said selected jacquard pattern into said warp yarns.

5. A method as defined in claim 1, wherein said woven pattern is maintained in alignment with said printed pattern by varying the longitudinal size of said printed pattern, wherein the longitudinal size of said printed pattern is varied by varying the amount of tension being applied to said warp yarns during formation of said fabric.

6. A method as defined in claim 1, wherein said weft yarns comprise different colored yarns.

7. A method as defined in claim 1, wherein said woven pattern comprises a jacquard pattern.

8. A method as defined in claim 1, wherein the position of said printed pattern is monitored by:

placing registration marks on said warp yarns at selected locations; and sequentially sensing the location of said registration marks as said fabric is being formed.

9. A method of synchronizing a woven pattern with a printed pattern during the fabrication of a fabric product, said method comprising the steps of:

providing a set of warp yarns having a printed pattern thereon;

weaving weft yarns into said warp yarns at a determined density of weft yarns per unit length for producing a fabric, said weft yarns being woven into said warp yarns in a manner such that a woven pattern is formed into said fabric;

monitoring the position of said printed pattern as said fabric is being woven; and based on the position of said printed pattern, selectively varying the density at which said weft yarns are woven into said warp yarns for maintaining said woven pattern in alignment with said printed pattern as said fabric is being formed.

10. A method as defined in claim 9, wherein said woven pattern comprises a jacquard pattern.

11. A method as defined in claim 10, wherein said jacquard pattern comprises a first motif and a second motif.

12. A method as defined in claim 9, wherein the position of said printed pattern is monitored by:

placing registration marks on said warp yarns at selected locations; and sequentially sensing the location of said registration marks as said fabric is being formed.

13. A method as defined in claim 9, wherein the position of said printed pattern is monitored by a pattern recognition device.

14. A weaving system for synchronizing a woven pattern with a printed pattern, said system comprising:

a weaving device for receiving a set of warp yarns having a printed pattern thereon, said weaving device being configured to insert weft yarns into said warp yarns for forming a fabric containing a woven pattern;

a sensor configured to monitor the position of said printed pattern on said warp yarns in relation to said weaving device; and a controller in communication with said sensor, said controller being configured to receive information from said sensor and, based on said information, to control said weaving device for selectively varying the longitudinal size of said woven pattern for maintaining said woven pattern in alignment with said printed pattern during formation of said fabric.

15. A weaving system as defined in claim 14, wherein said controller is configured to selectively vary the longitudinal size of said woven pattern by varying the density at which said weft yarns are inserted into said warp yarns.

16. A weaving system as defined in claim 14, further comprising a jacquard device in selective engagement with said warp yarns, said jacquard device being in communication with said weaving device for forming said woven pattern into said fabric, said woven pattern comprising a jacquard pattern.

17. A jacquard weaving system as defined in claim 16, wherein said jacquard device includes a jacquard controller preprogrammed with a plurality of jacquard patterns and wherein said controller is configured to vary the longitudinal size of said woven pattern by selecting one of said jacquard patterns stored in said jacquard controller, said selected jacquard pattern being woven into said fabric by said weaving device.

18. A weaving system as defined in claim 14, wherein said controller comprises a microprocessor.

19. A weaving system as defined in claim 14, wherein said sensor comprises an optical sensor.

20. A weaving system for synchronizing a woven pattern with a printed pattern, said system comprising:

a weaving device for receiving a set of warp yarns having a printed pattern thereon, said weaving device being configured to insert weft yarns into said warp yarns for forming a fabric containing a woven pattern;

a sensor configured to monitor the position of said printed pattern on said warp yarns in relation to said weaving device;

a tension control device configured to place a determined amount of tension on said warp yarns as said fabric is being woven; and a controller in communication with said sensor, said weaving device, and said tension control device, said controller being configured to receive information from said sensor and said weaving device and, based on said information, to control said tension control device for selectively varying the tension being exerted on said warp yarns, wherein, as said tension is varied, said printed pattern appearing on said warp yarns is selectively elongated and contracted in order to maintain said printed pattern in alignment with said woven pattern during formation of the fabric.

21. A weaving system as defined in claim 20, wherein said woven pattern has a longitudinal size, and wherein said controller is also configured to control said weaving device for selectively varying the longitudinal size of said woven pattern for maintaining said woven pattern in alignment with said printed pattern during formation of said fabric.

22. A weaving system as defined in claim 20, wherein the longitudinal size of said woven pattern is selectively varied by changing the density at which said weft yarns are woven into said warp yarns.

23. A weaving system as defined in claim 20, wherein said tension control device comprises a variable tension let off beam.

24. A weaving system as defined in claim 20, wherein said tension control device comprises an S wrap roller in communication with said warp yarns.

* * * * *